US010937605B2

(12) United States Patent
Zhang et al.

(10) Patent No.: US 10,937,605 B2
(45) Date of Patent: Mar. 2, 2021

(54) ELECTRICAL CONTACT SYSTEM

(71) Applicant: Tyco Electronics (Shenzhen) Co. Ltd, Shenzhen (CN)

(72) Inventors: Xiaoning Zhang, Shenzhen (CN); Teng Zou, Shenzhen (CN)

(73) Assignee: Tyco Electronics (Shenzhen) Co. Ltd., Shenzhen (CN)

( * ) Notice: Subject to any disclaimer, the term of this patent is extended or adjusted under 35 U.S.C. 154(b) by 0 days.

(21) Appl. No.: 16/698,434

(22) Filed: Nov. 27, 2019

(65) Prior Publication Data

US 2020/0098530 A1 Mar. 26, 2020

Related U.S. Application Data

(63) Continuation of application No. PCT/EP2018/064329, filed on May 31, 2018.

(30) Foreign Application Priority Data

Jun. 1, 2017 (CN) ..... 201710403589.3

(51) Int. Cl.
*H01H 1/20* (2006.01)
*H01H 3/40* (2006.01)
*H01H 9/32* (2006.01)

(52) U.S. Cl.
CPC ..... *H01H 9/32* (2013.01); *H01H 1/2041* (2013.01); *H01H 3/40* (2013.01)

(58) Field of Classification Search
CPC ..... H01H 1/2041; H01H 3/40; H01H 9/32; H01H 9/30; H01H 2009/305; H01H 33/06; H01H 73/045; H01H 73/18; H01H 3/32

(Continued)

(56) References Cited

U.S. PATENT DOCUMENTS 4,647,741 A * 3/1987 Belbel ..... H01H 9/32 218/117
4,849,591 A * 7/1989 Comtois ..... H01H 3/60 218/117

(Continued)

FOREIGN PATENT DOCUMENTS

CN 102376505 B 11/2013
FR 2982995 A1 5/2013

OTHER PUBLICATIONS

Translation CN102376505 (Original document published Mar. 14, 2012) (Year: 2012).*

(Continued)

*Primary Examiner* — William A Bolton
(74) *Attorney, Agent, or Firm* — Barley Snyder

(57) ABSTRACT

An electrical contact system includes a static contact having a static contact point, a movable contact having a movable contact point, a rotating member on which the movable contact is mounted, and an arc extinguishing device having an arc extinguishing sheet. The movable contact is rotatable with the rotating member between a switch-on position and a switch-off position. When the movable contact is rotated to the switch-on position, the arc extinguishing sheet is rotated beyond a contact area between the movable contact point and the static contact point, allowing electrical contact of the movable contact point with the static contact point. When the movable contact is rotated to the switch-off position, the arc extinguishing sheet is rotated into the contact area between the movable contact point and the static contact point, electrically isolating the movable contact point from the static contact point and cutting off an electric arc.

20 Claims, 3 Drawing Sheets

(58) Field of Classification Search
USPC ..... 218/117, 113, 110, 107, 81, 37, 30, 31, 218/147; 200/50.08, 50.22; 335/14, 16
See application file for complete search history.

(56) References Cited

U.S. PATENT DOCUMENTS

| | | | | |
|---|---|---|---|---|
| 4,880,948 | A * | 11/1989 | Kandatsu | H01H 9/32 218/117 |
| 4,943,691 | A * | 7/1990 | Mertz | H01H 9/32 218/117 |
| 6,084,193 | A * | 7/2000 | Pellon | H01H 9/32 218/117 |
| 8,686,311 | B2 * | 4/2014 | Vigouroux | H01H 71/526 218/147 |
| 2014/0048513 | A1 | 2/2014 | Sato et al. | |

OTHER PUBLICATIONS

Translation FR2982995 (Original document published May 24, 2013) (Year: 2013).*
Notification, and the International Search Report and the Written Opinion of the International Searching Authority, PCT/EP2018/064329 dated Aug. 17, 2018, 14 pages.
Abstract of CN 102376505 B, dated Nov. 27, 2013, 2 pages.
Abstract of FR 2982995, dated May 24, 2013, 1 page.

* cited by examiner

ELECTRICAL CONTACT SYSTEM

CROSS-REFERENCE TO RELATED APPLICATIONS

This application is a continuation of PCT International Application No. PCT/EP2018/064329, filed on May 31, 2018, which claims priority under 35 U.S.C. § 119 to Chinese Patent Application No. 201710403589.3, filed on Jun. 1, 2017.

FIELD OF THE INVENTION

The present invention relates to an electrical contact system and, more particularly, to an electrical contact system having an arc extinguishing device.

BACKGROUND

An electrical contact in an electric switch device may discharge and generate an electric arc during switching on to off or off to on. The generation of the electric arc may delay connection and disconnection of the circuit and even burn the electrical contacts, resulting in the melting and welding of the electrical contacts. In a severe case, it may cause ignition and explosion of the electric switch device. An arc extinguishing device is required to achieve an efficient and reliable arc extinguishing effect.

An electric switch device, such as a high-voltage direct current relay, usually uses a sealed inflatable magnetic field to lengthen a metal phase electric arc laterally, so that the electric arc may be cooled and deionized rapidly in an arc extinguishing medium. Such a method has a good arc extinguishing effect, but the manufacturing process thereof is complex, which results in a high cost. Another way to extinguish the arc is to use a strong magnetic field to extinguish the electric arc in an air medium. However, because of the strong ionization of the electric arc in the air medium, this may lead to an undesired arc effect such as the melting and welding of the electrical contacts. A large internal space is also required, impairing miniaturization of the switchgear.

SUMMARY

An electrical contact system includes a static contact having a static contact point, a movable contact having a movable contact point, a rotating member on which the movable contact is mounted, and an arc extinguishing device having an arc extinguishing sheet. The movable contact is rotatable with the rotating member between a switch-on position and a switch-off position. When the movable contact is rotated to the switch-on position, the arc extinguishing sheet is rotated beyond a contact area between the movable contact point and the static contact point, allowing electrical contact of the movable contact point with the static contact point. When the movable contact is rotated to the switch-off position, the arc extinguishing sheet is rotated into the contact area between the movable contact point and the static contact point, electrically isolating the movable contact point from the static contact point and cutting off an electric arc.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
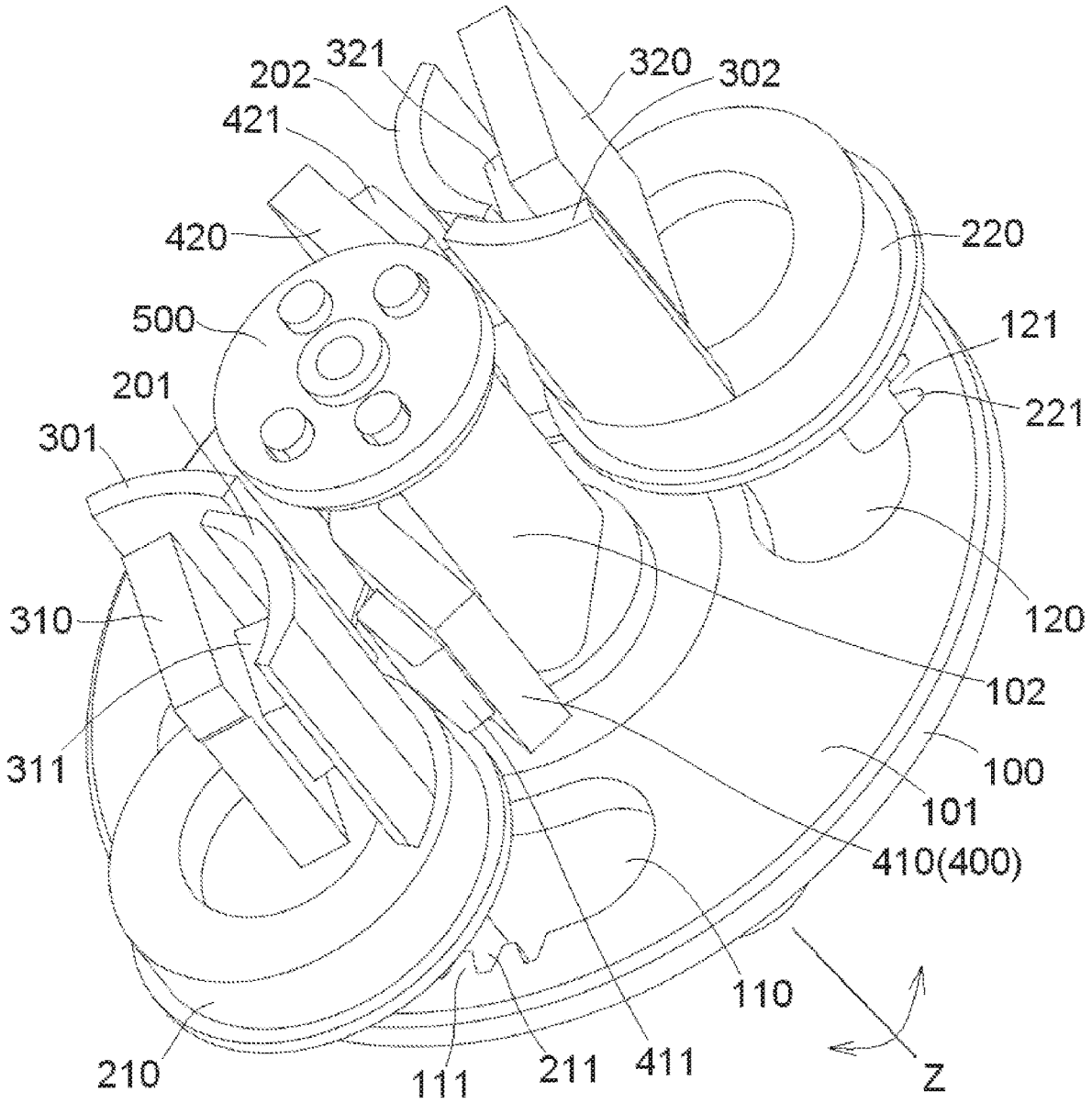
FIG. 1 is a perspective view of an electrical contact system according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiment set forth herein; rather, these embodiments are provided so that the present disclosure will convey the concept of the disclosure to those skilled in the art.

In addition, in the following detailed description, for purpose of explanation, numerous specific details are set forth in order to provide a thorough understanding of the disclosed embodiments. However, it is apparent that one or more embodiments may also be implemented without these specific details. In other instances, well-known means and devices are schematically shown in the drawings to simplify the drawings.

Figure 2:
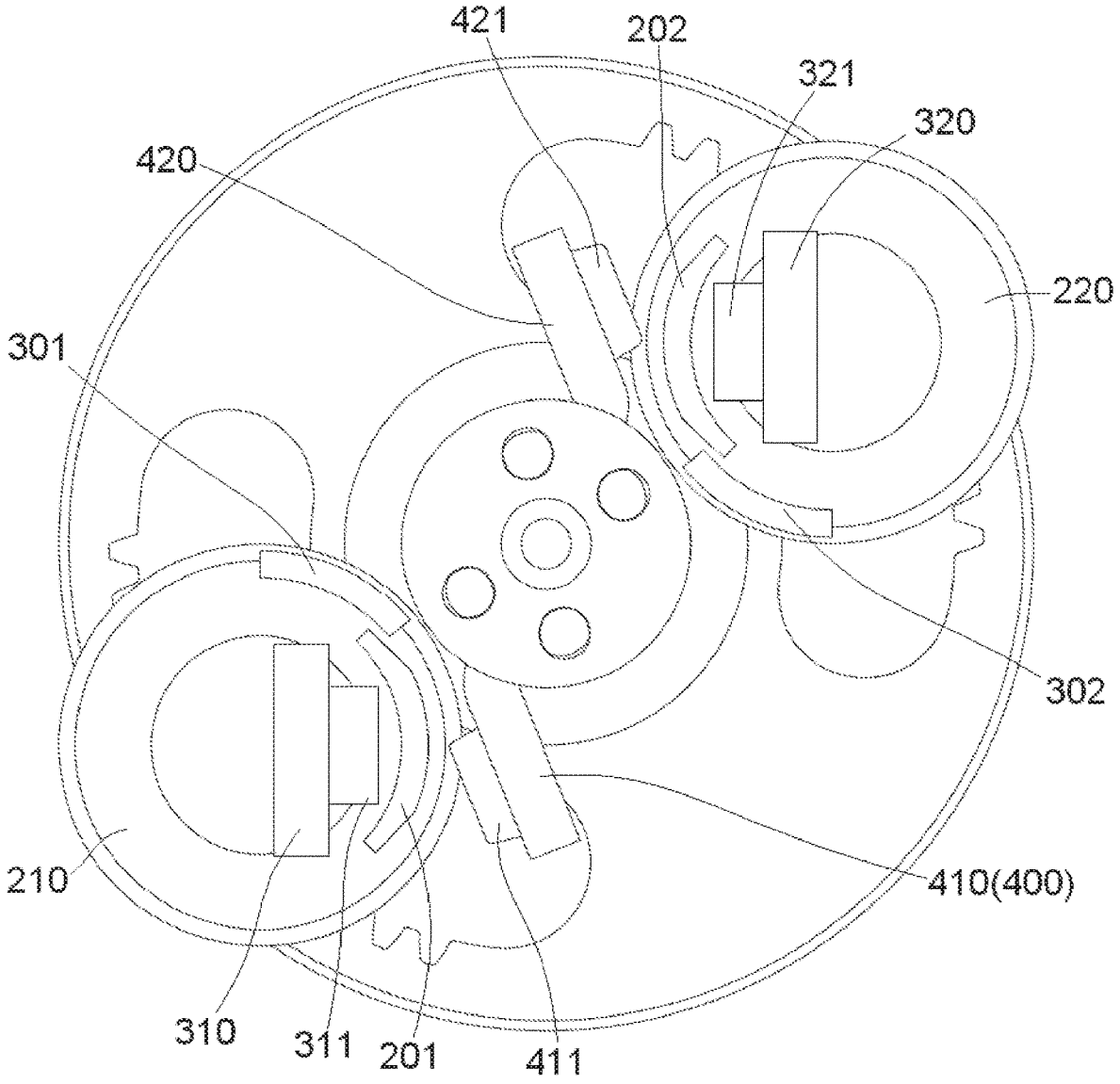
FIG. 2 is a plan view of the electrical contact system in which a movable contact is separated from a static contact.
Figure 3:
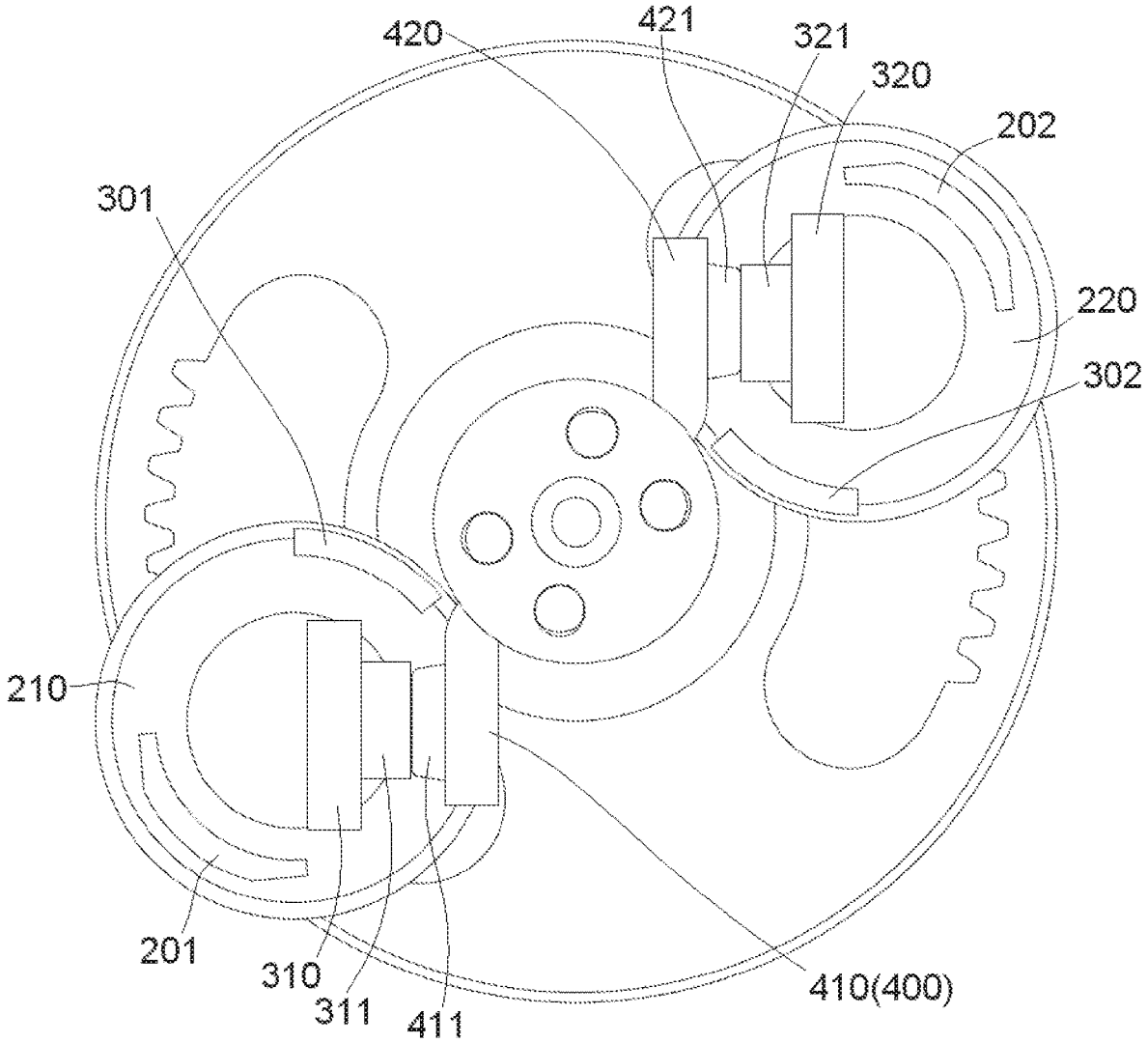
FIG. 3 is a plan view of the electrical contact system in which the movable contact is in contact with the static contact.

An electrical contact system according to an embodiment, as shown in FIGS. 1-3, includes a movable contact 400, a static contact 310, 320, a rotating member 100, and an arc extinguishing device 210, 220. The movable contact 400 has a movable contact point 411, 421, and the static contact 310, 320 has a plurality of static contact points 311, 321. The movable contact 400 is mounted on the rotating member 100 and is rotatable with the rotating member 100 about the rotation axis Z of the rotating member 100 between a switch-on position and a switch-off position.

As shown in FIG. 3, when the movable contact 400 is rotated to the switch-on position, the movable contact point 411, 421 is in electrical contact with the static contact points 311, 321. As shown in FIGS. 1 and 2, when the movable contact 400 is rotated to the switch-off position, the movable contact point 411, 421 is separated from the static contact points 311, 321.

The arc extinguishing device 210, 220, as shown in FIGS. 1-3, has an arc extinguishing sheet 201, 202 and is meshed with the rotating member 100. Therefore, when the rotating member 100 is rotated about its rotation axis Z, the rotating member 100 drives the arc extinguishing sheet 201, 202 of the arc extinguishing device 210, 220 to rotate around the rotation axis of the arc extinguishing device 210, 220.

As shown in FIG. 3, when the movable contact 400 is rotated to the switch-on position, the arc extinguishing sheet 201, 202 is rotated beyond a contact area between the movable contact point 411, 421 and the static contact point 311, 321, allowing the movable contact point 411, 421 to be in electrical contact with the static contact point 311, 321. As shown in FIGS. 1 and 2, when the movable contact 400 is rotated to the switch-off position, the arc extinguishing sheet 201, 202 is rotated into the contact area between the movable contact point 411, 421 and the static contact point 311, 321 such that the movable contact point 411, 421 is electrically isolated from the static contact point 311, 321, thereby cutting off the electric arc between the movable contact point 411, 421 and the static contact point 311, 321.

The electrical contact system has dual contact points. As shown in FIG. 1, the static contacts 310, 320 include a first static contact 310 and a second static contact 320. The movable contact 400 is located between the first static contact 310 and the second static contact 320. The first static contact 310 has a first static contact point 311, and the second static contact 320 has a second static contact point 321. A first movable contact point 411 is provided at a first end 410 of the movable contact 400, and a second movable contact point 421 is provided at a second end 420 of the movable contact 400. The arc extinguishing devices 210, 220 include a first arc extinguishing device 210 and a second arc extinguishing device 220. The first arc extinguishing device 210 has a first arc extinguishing sheet 201, and the second arc extinguishing device 220 has a second arc extinguishing sheet 202.

As shown in FIGS. 1 and 2, when the movable contact 400 is rotated to the switch-off position, the first arc extinguishing sheet 201 is rotated into the contact area between the first movable contact point 411 and the first static contact point 311, and the second arc extinguishing sheet 202 is rotated into the contact area between the second movable contact point 421 and the second static contact point 321 such that the first movable contact point 411 and the second movable contact point 421 are electrically isolated from the first static contact point 311 and the second static contact point 321, respectively. By doing so, the electric arc between the first movable contact point 411 and the first static contact point 311 and the electric arc between the second movable contact point 421 and the second static contact point 321 may be rapidly cut off.

As shown in FIG. 3, when the movable contact 400 is rotated to the switch-on position, the first arc extinguishing sheet 201 is rotated out of the contact area between the first movable contact point 411 and the first static contact point 311, and the second arc extinguishing sheet 202 is rotated out of the contact area between the second movable contact point 421 and the second static contact point 321, thereby allowing the first movable contact point 411 and the second movable contact point 421 to be in electrical contact with the first static contact point 311 and the second static contact point 321, respectively.

The rotating member 100, as shown in FIG. 1, includes a disk-shaped base 101 and a cylindrical portion 102 that protrudes from the disk-shaped base 101. The movable contact 400 is mounted on the cylindrical portion 102 of the rotating member 100. A first gear 111 and a second gear 121 are formed on the disk-shaped base 101 of the rotating member 100. A first mating gear 211 to be meshed with the first gear 111 is formed on the first arc extinguishing device 210. A second mating gear 221 to be meshed with the second gear 121 is formed on the second arc extinguishing device 220.

As shown in FIG. 1, a first groove 110 and a second groove 120 are formed on the disk-shaped base 101 of the rotating element 100. The first gear 111 and the second gear 121 are respectively formed on edge portions of the first groove 110 and the second groove 120. A mounting groove is formed in the cylindrical portion 102 of the rotating member 100. A main body portion of the movable contact 400 is installed in the mounting groove, and is locked on the cylindrical portion 102 of the rotating member 100 by a locking cap 500 attached to an end of the cylindrical portion 102 of the rotating member 100.

The electrical contact system, as shown in FIGS. 1-3, includes a static first insulating wall 301 and a static second insulating wall 302 which are unmovable with respect to the first static contact point 311 and the second static contact point 321, respectively. The first insulating wall 301 and the second insulating wall 302 may be formed on an insulator where the first static contact 310 and the second static contact 320 are mounted. The first insulating wall 301 is located on a first side of the first static contact point 311, and the second insulating wall 302 is located on a first side of the second static contact point 321.

When the movable contact 400 is rotated to the switch-off position, the first arc extinguishing sheet 201 is partially overlapped with the first insulating wall 301. In this way, the electric arc between the first movable contact point 411 and the first static contact point 311 may be quickly cut off by the first arc extinguishing sheet 201 and the first insulating wall 301 which have a scissor-like effect. Similarly, as shown in FIGS. 1 and 2, when the movable contact 400 is rotated to the switch-off position, the second arc extinguishing sheet 202 is partially overlapped with the second insulating wall 302. In this way, the arc between the second movable contact point 421 and the second static contact point 321 may be quickly cut off by the second arc extinguishing sheet 202 and the second insulating wall 302, which have a scissor-like effect.

As shown in FIGS. 1-3, when the movable contact 400 is rotated from the switch-on position to the switch-off position, the first arc extinguishing sheet 201 is driven to enter the contact area between the first static contact point 311 and the first movable contact point 411 from a second side of the first static contact point 311 until the first arc extinguishing sheet 201 partially overlaps with the first insulating wall 301. When the movable contact 400 is rotated from the switch-on position to the switch-off position, the second arc extinguishing sheet 202 is driven to enter the contact area between the second static contact point 321 and the second movable contact point 421 from a second side of the second static contact point 321 until the second arc extinguishing sheet 202 partially overlaps with the second insulating wall 302.

As shown in FIGS. 1-3, when the movable contact 400 is rotated from the switch-off position to the switch-on position, the first arc extinguishing sheet 201 is driven to leave the contact area between the first static contact point 311 and the first movable contact point 411 from the second side of the first static contact point 311 until it moves out of the contact area between the first static contact point 311 and the first movable contact point 411. When the movable contact 400 is rotated from the switch-off position to the switch-on position, the second arc extinguishing sheet 202 is driven to leave the contact area between the second static contact point 321 and the second movable contact point 421 from the second side of the second static contact point 321 until it moves out of the contact area between the second static contact point 321 and the second movable contact point 421.

In the foregoing exemplary embodiments of the present disclosure, the arc extinguishing 210, 220 device is meshed with the gear 111, 121 of the rotating member 100. Therefore, the arc extinguishing device 210, 220 may be driven by the rotating member 100 to be rotated into the contact area between the movable contact point 411, 421 and the static contact point 311, 321, so that the electric arc between the movable contact point 411, 421 and the static contact point 311, 321 may be quickly cut off to achieve an efficient and reliable arc extinguishing effect. In addition, it is not necessary in the present disclosure to provide a driving device that drives the arc extinguishing device 210, 220 independently to rotate, and a simple structure and a low cost are achieved.

What is claimed is:

1. An electrical contact system, comprising:

a static contact having a static contact point;

a movable contact having a movable contact point;

a rotating member on which the movable contact is mounted and including a disk-shaped base having at least one gear formed thereon, the movable contact is rotatable with the rotating member between a switch-on position and a switch-off position, when the movable contact is rotated to the switch-on position the movable contact point is in electrical contact with the static contact point, and when the movable contact is rotated to the switch-off position, the movable contact point is separated from the static contact point; and an arc extinguishing device geared with the at least one gear of the rotating member and having an arc extinguishing sheet, when the movable contact is rotated to the switch-on position the arc extinguishing sheet is rotated beyond a contact area between the movable contact point and the static contact point, allowing electrical contact of the movable contact point with the static contact point, and when the movable contact is rotated to the switch-off position, the arc extinguishing sheet is rotated into the contact area between the movable contact point and the static contact point such that the movable contact point is electrically isolated from the static contact point, cutting off an electric arc between the movable contact point and the static contact point.

2. The electrical contact system of claim 1, wherein the static contact includes a first static contact and a second static contact, the movable contact is between the first static contact and the second static contact.

3. The electrical contact system of claim 2, wherein the first static contact has a first static contact point, the second static contact has a second static contact point, and the movable contact has a first movable contact point at a first end and a second movable contact point at a second end.

4. The electrical contact system of claim 3, wherein the arc extinguishing device has a first arc extinguishing device with a first arc extinguishing sheet and a second arc extinguishing device with a second arc extinguishing sheet.

5. The electrical contact system of claim 4, wherein when the movable contact is rotated to the switch-off position, the first arc extinguishing sheet is rotated into the contact area between the first movable contact point and the first static contact point, and the second arc extinguishing sheet is rotated into the contact area between the second movable contact point and the second static contact point, so that the first movable contact point and the second movable contact point are electrically isolated from the first static contact point and the second static contact point.

6. The electrical contact system of claim 4, wherein when the movable contact is rotated to the switch-on position, the first arc extinguishing sheet is rotated out of the contact area between the first movable contact point and the first static contact point, and the second arc extinguishing sheet is rotated out of the contact area between the second movable contact point and the second static contact point, allowing the first movable contact point and the second movable contact point to be in electrical contact with the first static contact point and the second static contact point.

7. The electrical contact system of claim 4, wherein the rotating member has a cylindrical portion protruding from the disk-shaped base.

8. The electrical contact system of claim 7, wherein the movable contact is mounted on the cylindrical portion.

9. The electrical contact system of claim 8, wherein the at least one gear comprises a first gear and a second gear formed on the disk-shaped base.

10. The electrical contact system of claim 9, wherein the first arc extinguishing device has a first mating gear to be meshed with the first gear.

11. The electrical contact system of claim 10, wherein the second arc extinguishing device has a second mating gear to be meshed with the second gear.

12. The electrical contact system of claim 11, wherein the disk-shaped base has a first groove and a second groove, the first gear is formed on an edge portion of the first groove and the second gear is formed on an edge portion of the second groove.

13. The electrical contact system of claim 8, wherein the cylindrical portion has a mounting groove, a main body portion of the movable contact is mounted in the mounting groove.

14. The electrical contact system of claim 13, wherein the main body portion of the movable contact is locked on the cylindrical portion by a locking cap attached to an end of the cylindrical portion.

15. The electrical contact system of claim 4, further comprising a static first insulating wall and a static second insulating wall.

16. The electrical contact system of claim 15, wherein when the movable contact is rotated to the switch-off position, the first arc extinguishing sheet is partially overlapped with the static first insulating wall and the second arc extinguishing sheet is partially overlapped with the static second insulating wall.

17. The electrical contact system of claim 16, wherein the static first insulating wall is located on a first side of the first static contact point and the second insulating wall is located on a first side of the second static contact point.

18. The electrical contact system of claim 17, wherein when the movable contact is rotated from the switch-on position to the switch-off position, the first arc extinguishing sheet is driven to enter the contact area between the first static contact point and the first movable contact point from a second side of the first static contact point, and the second arc extinguishing sheet is driven to enter the contact area between the second static contact point and the second movable contact point from a second side of the second static contact point.

19. An electrical contact system, comprising:

a first static contact having a first static contact point;

a second static contact having a second static contact point;

a movable contact having a first movable contact point and a second movable contact point;

a rotating member including a base defining a first gear and a second gear, and on which the movable contact is mounted, the movable contact is rotatable with the rotating member between a switch-on position and a switch-off position, when the movable contact is rotated to the switch-on position the movable contact point is in electrical contact with the static contact point, and when the movable contact is rotated to the switch-off position, the movable contact point is separated from the static contact point; and an arc extinguishing device including a first arc extinguishing device with a first arc extinguishing sheet and a second arc extinguishing device with a second arc extinguishing sheet, the first and second arc extinguishing devices geared with the rotating member via a respective one of the first gear and the second gear, when the movable contact is rotated to the switch-on position the first and second arc extinguishing sheets are rotated beyond respective contact areas between the first and second movable contact points and the first and second static contact points, allowing electrical contact of the first and second movable contact points with respective the first and second static contact points, and when the movable contact is rotated to the switch-off position, the first and second arc extinguishing sheets are rotated into the respective contact areas between the first and second movable contact points and the first and second static contact points such that the first and second movable contact points are electrically isolated from respective first and second static contact points.

20. An electrical contact system, comprising:

a static contact having a static contact point;

a movable contact having a movable contact point;

a rotating member on which the movable contact is mounted and including a base having a first driving surface formed thereon, the movable contact is rotatable with the rotating member between a switch-on position and a switch-off position, when the movable contact is rotated to the switch-on position the movable contact point is in electrical contact with the static contact point, and when the movable contact is rotated to the switch-off position, the movable contact point is separated from the static contact point; and an arc extinguishing device including:

a second driving surface drivingly engaged with the first driving surface of the rotating member for, in response to the rotation of the rotating member, rotating the arc extinguishing device in a direction opposite the rotating member; and an arc extinguishing sheet, when the movable contact is rotated to the switch-on position the arc extinguishing sheet is rotated beyond a contact area between the movable contact point and the static contact point, allowing electrical contact of the movable contact point with the static contact point, and when the movable contact is rotated to the switch-off position, the arc extinguishing sheet is rotated into the contact area between the movable contact point and the static contact point such that the movable contact point is electrically isolated from the static contact point, cutting off an electric arc between the movable contact point and the static contact point.

* * * * *